United States Patent [19]

Workman et al.

[11] Patent Number: 5,029,710

[45] Date of Patent: Jul. 9, 1991

[54] TEST CYLINDER MOLD PACKAGING

[75] Inventors: Gary Workman, Lombard; John M. Fitzpatrick, Lake Bluff, both of Ill.

[73] Assignee: Deslauriers, Inc., Bellwood, Ill.

[21] Appl. No.: 511,200

[22] Filed: Apr. 19, 1990

[51] Int. Cl.[5] ..... B65D 21/02

[52] U.S. Cl. ..... 206/503; 53/467; 206/821; 220/23.4; 220/4.24; 220/4.27

[58] Field of Search ..... 53/467; 206/503, 821; 220/4.24, 4.27, 23.4, 23.83; 229/DIG. 11, 915

[56] References Cited

U.S. PATENT DOCUMENTS

| | | | |
|---|---|---|---|
| 2,632,593 | 3/1953 | Minster | 206/602 X |
| 2,802,614 | 8/1957 | Gelin | 206/503 X |
| 3,146,505 | 9/1964 | Hansen | 206/821 X |
| 3,389,830 | 6/1968 | Smith | 220/23.4 |
| 3,552,579 | 1/1971 | Simon | 206/821 X |

*Primary Examiner*—John Sipos

*Attorney, Agent, or Firm*—Wood, Phillips, Mason, Recktenwald & VanSanten

[57] ABSTRACT

A packaging assembly is provided for facilitating shipment and use of articles contained therein. The packaging assembly includes a pair of identical cartons, one positioned atop the other, and suitable connectors for maintaining the cartons in assembled relation. The connector elements may comprise staples, an adhesive strap, or connector elements disposed partially within each container for maintaining the cartons in assembled relation during shipment. When in use, the connector elements can be removed to separate the containers.

7 Claims, 2 Drawing Sheets

TEST CYLINDER MOLD PACKAGING

FIELD OF THE INVENTION

This invention relates to packaging and, more particularly, to a packaging assembly for facilitating shipment and use of articles contained therein.

BACKGROUND OF THE INVENTION

The invention disclosed herein is related to the packaging of articles to facilitate shipment and use of such articles. In the illustrated embodiment, the packaging assembly is described in connection with packaging for concrete test cylinder molds. A test cylinder mold is a hollow cylindrical container including a bottom wall which is used to test specimens of concrete at a construction site. Such molds are generally disposable. For illustration herein, such molds in one form are 12" long include a 6" inner diameter.

Initially, such molds were made of paperboard with metal bottoms and packaged twenty-four per carton. Such a carton was approximately 25" long, 19" wide and 25" high. Packaging was from the top and consisted of two layers of twelve molds. Such a carton size was selected as it corresponded to size of trucks and rail cars and also provided the package with multiples of four. In fact, usage of the cylinder molds is typically in units of four, thus packaging should retain this criteria.

Subsequently, paperboard molds were replaced by plastic molds similar in size and using the standard packaging arrangement discussed above.

Another consideration in the packaging of articles is the cost of shipment thereof. Often, it is desirable in shipping smaller quantities to ship by services such as United Parcel Service (UPS). UPS at one time maintained a requirement of maximum 108" of girth and height combined. Consequently, the old packaging was modified to a twenty pack which was end loaded and had outside dimensions of 12¾" wide, 25½" long and 31½" high. Such a carton satisfied the UPS requirements and also provided a package which could be carried in the trunk of a car, unlike the twenty-four pack discussed above. Further, such an arrangement allowed packaging in multiples of four.

More recently, UPS has changed its specifications to allow a maximum 130" of girth and height combined, while charging for a minimum of twenty-five pounds on any package over 84" girth and height combined In view of these requirements, it is desirable to have a packaging arrangement which is within the size requirements, while also being as close as possible to the weight requirements in order to save on shipping costs. However, such requirements should be balanced with the desire to provide a packaging arrangement which is easy to handle in the field, such as allowing a user to carry the packaging in one's trunk.

The present invention is intended to overcome one or more of the problems set forth above.

SUMMARY OF THE INVENTION

In accordance with the invention, there is disclosed herein a packaging arrangement including a pair of cartons assembled to one another for shipment and being readily separable during use.

Broadly, there is disclosed here an improved packaging assembly for facilitating shipment and use of goods carried therein. The assembly comprises a pair of cartons of identical configuration for carrying like goods, each carton having a rectangular top wall and a rectangular bottom wall connected by four side walls. Means are provided for supporting the cartons in assembled relationship with the bottom wall of one of the cartons being positioned atop the top wall of the other carton in aligned, abutting facial engagement and including means for securing the pair of cartons in assembled relation during shipment and permitting disassembly during use.

According to one aspect of the invention, the packaging assembly is provided with metal fasteners for securing said pair of cartons.

Is a feature of the invention that such metal fasteners comprise staples.

It is a further feature of the invention wherein the top wall of each said carton comprises a pair of end flaps and a pair of side flaps and the top carton is positioned atop the end flaps of the bottom carton and between the side flaps of the bottom carton.

It is still another feature of the invention that the securing means secure the side flaps of the bottom carton with the side walls of the top carton.

In accordance with another aspect of the invention, two of the side walls of each carton comprise open opposite ends having foldable flaps to close and seal the carton, and the securing means comprise a plurality of connector tabs each inserted into one open end of both containers to thereby maintain the containers in assembled relation incident to folding said flaps to close and seal the cartons.

It is a feature of the invention that there are two connectors at each end.

As a further feature of the invention wherein each connector is received in a matted slot in each carton.

There is disclosed herein in accordance with a further aspect of the invention a packaging assembly for facilitating shipment and use of articles contained therein. The assembly includes a pair of cartons of identical configuration for carrying like goods, each carton having a rectangular top wall and a rectangular bottom wall connected by four side walls. Means are provided for supporting the cartons in assembled relation with the bottom wall of one carton being position atop the top wall of the other carton in aligned, abutting facial engagement. The supporting means comprises a plurality of removable connector elements each disposed partially within each carton for securing the pair of cartons in assembled relation during shipment and permitting disassembly during use upon removable of the connector elements.

It is a feature of the invention that the connector element comprises paperboard connector elements.

It is a further feature of the invention wherein each connector element comprise a molded plastic connector element.

It is still another feature of the invention wherein each connector element comprises a generally U-shaped connector element.

Further features and advantages of the invention will readily be apparent from the specification and from the drawings. dr

DETAILED DESCRIPTION OF THE INVENTION

Figure 1:
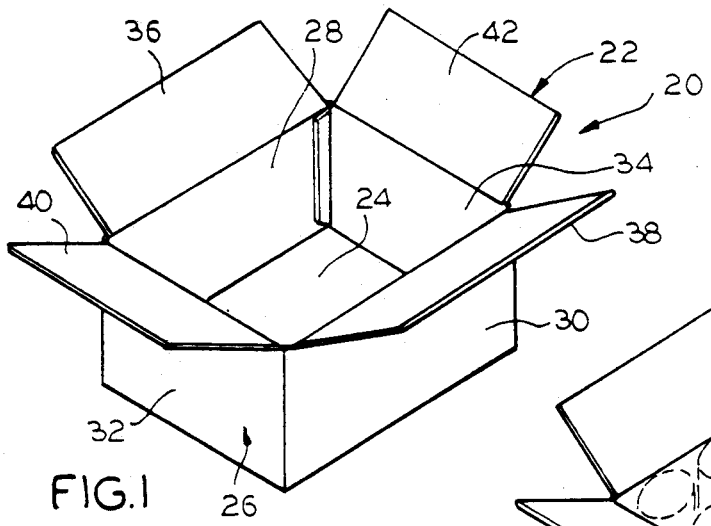
FIG. 1 is a perspective view of an open, empty carton for use in a packaging assembly according to a first embodiment of the invention.

With reference to FIG. 1, there is illustrated an empty cardboard carton 20 of conventional construction including a rectangular top wall 22 and a rectangular bottom wall 24 connected by a peripheral wall 26. The peripheral wall 26 includes opposite side walls 28 and 30 connected by opposite end walls 32 and 34. As is apparent, the top wall 22 comprises opposite side flaps 36 and 38 extending upwardly from the side walls 28 and 30, respectively, and end flaps 40 and 42 extending upwardly from the end walls 32 and 34, respectively. Although not shown, the bottom wall 24 may be similar in construction to the top wall 28 and for purposes herein is assumed to be suitably closed and sealed for purposes described herein.

Figure 2:
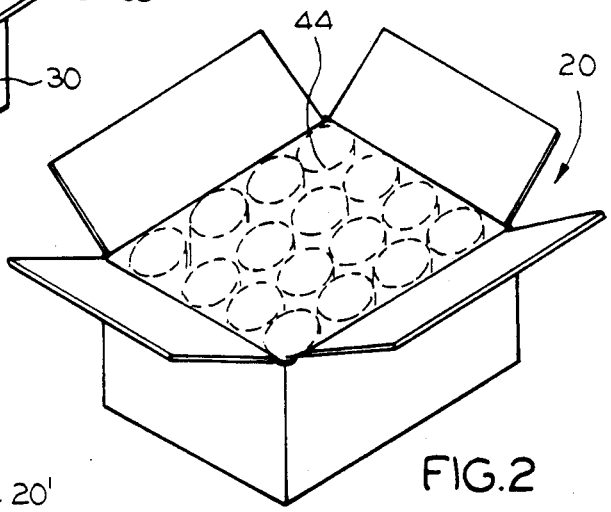
FIG. 2 is a perspective view similar to that of FIG. 1 illustrating the carton filled with an article to be contained therein.

With reference to FIG. 2, the carton 20 is illustrated containing sixteen test cylinder molds 44. In the illustrated embodiment, each mold 44 is a cylindrical mold approximately 12" long and having an inner diameter of 6". The dimensions of the carton 20 are selected to support sixteen of the molds 44 in a single layer configuration, as illustrated.

The use of a single carton 20 to support sixteen molds, as discussed above, is preferable to field personnel for handling. It maintains the packaging to contain molds 44 in multiples of four. By using a container of such size, the carton 20 will readily fit into the trunk of a car. However, in order to provide economies in shipping, it is desirable that a pair of such cartons 20 be shipped as a single unit.

Figure 4:
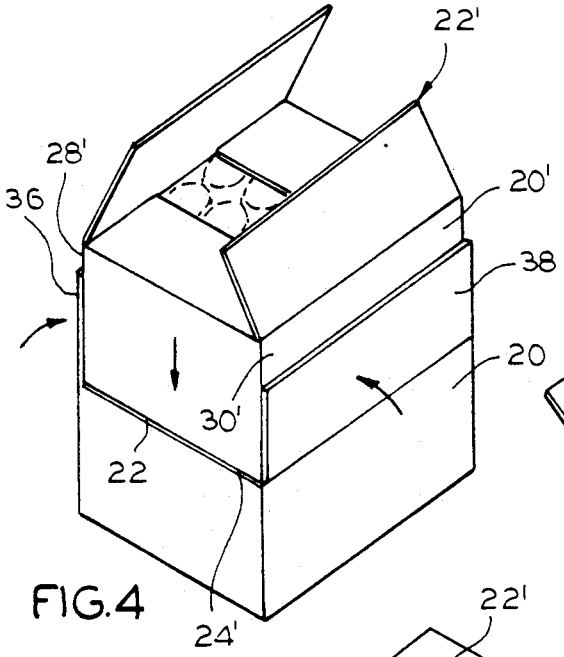
FIG. 4 is a perspective view illustrating a pair of cartons such as in FIG. 3 in assembled relation with one atop the other.
Figure 3:
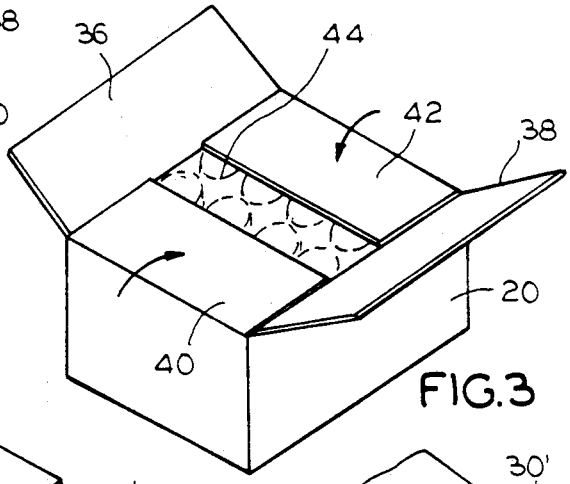
FIG. 3 is a perspective view similar to that of FIG. 2 showing end flaps of the carton turned to the closed position.

With reference to FIG. 3 and 4, a sequence is illustrated for assembling a pair of cartons 20 and 20' in assembled relation. Initially, with reference to FIG. 3, the bottom most carton 20, filled with molds 44 is placed on any surface and the end flaps 40 and 42 are folded downwardly as illustrated to the closed position. The side flaps 36 and 38 are left in their normal position and extending generally outwardly as illustrated. Next, a second carton 20', identical in size and configuration to the carton 20, is placed with its bottom wall 24' atop the top wall 22 of the bottom carton 20 in aligned, abutting facial engagement. Particularly, the top carton 20' is placed atop the folded down end flaps 40 and 42 and between the side flaps 36 and 38. Although the top carton 20' is illustrated with its top wall 22' in the open position, such top wall 22' may be closed and sealed prior to assembly. Once the cartons 20 and 20' are assembled as illustrated, the bottom carton side flaps 36 and 38 are turned inwardly to abut the side walls 28' and 30' of the top carton 20'.

Figure 5:
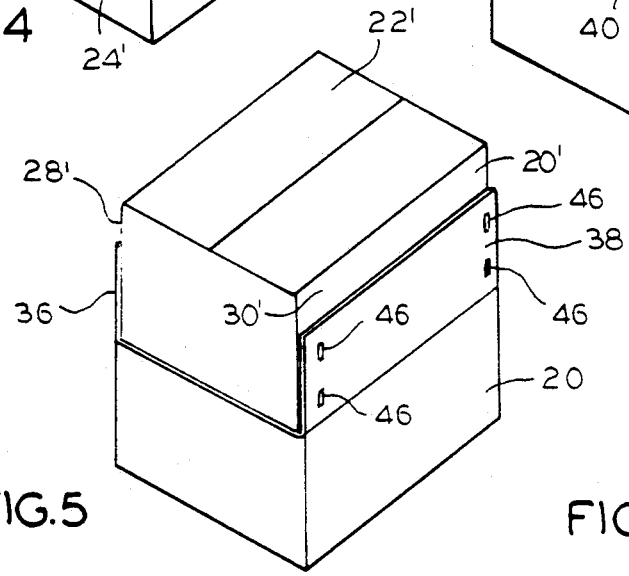
FIG. 5 illustrates the use of metal connectors for connecting the cartons assembled in FIG. 4.

With reference to FIG. 5, the cartons 20 and 20' according to one aspect of the invention, are secured in assembled relation utilizing a plurality of metal staples 46 driven through each bottom carton side flap 36 and 38 into the top carton side walls 28' and 30', respectively. Owing to the relative light weight of the two cartons, such metal staples 46 are sufficient to maintain the cartons 20 and 20' in assembled relation during shipping. Once in the field, the cartons 20 and 20' may be separated by removing the staples 46 with the result that the customer has two separate cartons, each filled with sixteen molds 44, as illustrated in FIG. 2.

Figure 6:
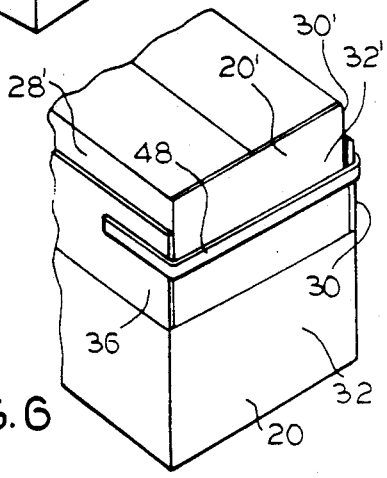
FIG. 6 illustrates the use of an adhesive band for securing the cartons assembled as in FIG. 4.

With reference to FIG. 6, a method of securing the cartons 20 and 20' in accordance with another aspect of the invention as illustrated. Specifically, an adhesive strapping element 48, such as a relatively durable tape, is used to maintain the cartons 20 and 20' in assembled relation. Particularly, the tape 48, one piece at each end, is secured to the bottom carton side flap 36, the top carton end wall 32', and the opposite bottom cartons side wall flap 30. At the opposite end, although not shown, a similar piece of tape 48 is used, except it is adhered to the end wall 34'. As above, the tape 48 maintains the cartons 20 and 20' in assembled relation during shipment. Once in the field, the tape 48 can be easily removed to provide separate cartons 20 and 20'.

With the cartons 20 and 20' assembled as illustrated in FIGS. 5 and 6, the combined size is within the UPS allowable size limits and the combined weight is approximately twenty-five pounds.

Figure 7:
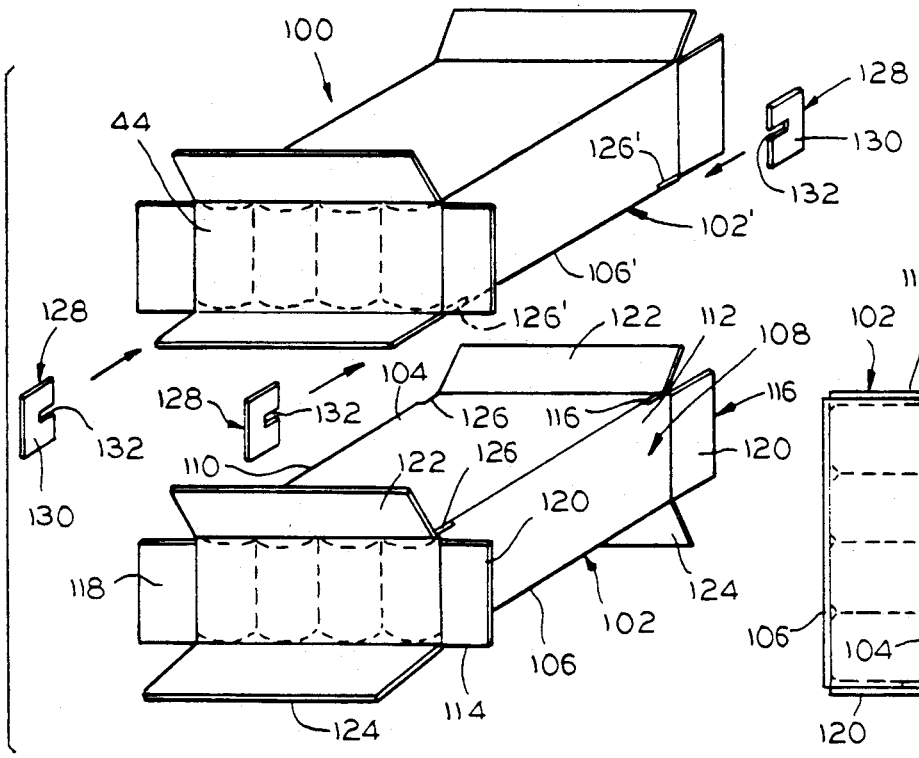
FIG. 7 illustrates an exploded view of a packaging assembly according to a second embodiment of the invention including connector elements for maintaining a pair of cartons in assembled relation.

With reference to FIG. 7, there is illustrated a packaging assembly according to an alternative embodiment of the invention. The packaging assembly 100 comprises a bottom carton 102 and a similar top carton 102'. Since each of the cartons 102 and 102' are identical in construction, only the carton 102 will be discussed in detail herein, it being understood that the carton 102' includes similar elements referenced with like, primed reference numerals.

The carton 102 includes a top wall 104 and a bottom wall 106 connected by a peripheral wall 108. The peripheral wall 108 includes opposite side walls 110 and 112 each connected to the top wall 104 and the bottom wall 106. The peripheral side wall 108 also includes opposite end walls 114 and 116. Each end wall 114 and 116 is formed of flaps to provide end loading for the carton 102. Particularly, the end wall 114 includes opposite side flaps 118 and 120 connected to the respective side walls 110 and 112, a top flap 122 connected to the top wall 104, and a bottom flap 124 connected to the bottom wall 106. The opposite end wall 116 includes a duplicate set of flaps indicated with like reference numerals.

To facilitate assembly of the cartons 102 and 102', there is provided an elongate slot 126 at the four corners of the top wall 104 along the edges intersecting with the side walls 110 and 112 extending from the end walls 114 and 116.

The carton 102' is identical in construction to the carton 102. However, to permit assembling, the carton 102′ is flipped over 180 degrees so that its slots 126′ are in what is then considered the bottom wall.

Each carton 102 and 102′ is of a size and configuration to hold sixteen test cylinder molds 44, similar to the carton 20 discussed above. However, in the embodiment of FIG. 7, the test cylinder molds are end loaded as shown. Owing to the use of flaps in the end walls 114 and 116, rather than the top and bottom walls 22 and 24, as shown in FIG. 1, the carton 102 is less expensive to manufacture as it uses less cardboard. This is due to the fact that the area of the end walls is less than the area of the top and bottom walls so that less overlapping is necessary for closing and sealing the containers, as is apparent.

To assemble the cartons 102 and 102′, the top carton 102 is placed upside down, as discussed above, atop the bottom carton 102. In so doing, the top carton bottom wall, actually its top wall, is in alignment with the bottom carton top wall 104. Incident to such alignment, the bottom carton slots 126 are in registry with the top carton slots 126′. In accordance with the invention, a plurality of connector elements 128 are used for maintaining the cartons 102 and 102′ in assembled relations.

Each connector element 128 comprises a flat plate or tab 130 including a slot 132 extending inwardly from one edge to provide a generally U-shaped configuration. Connector elements 128 may be of cardboard construction, or may be of molded plastic construction.

Figure 10:
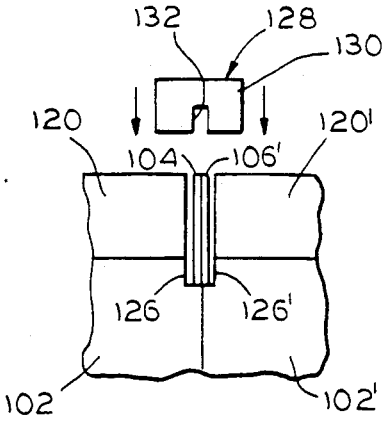
FIG. 10 and FIG. 11 illustrate in partial side view the method for installing the connector elements in the cartons of FIG. 7.

As is particularly illustrated in FIG. 10, one of each said connector elements 128 is positioned in alignment with a corner of the two cartons 102 and 102′ and registered with the adjacent slots 126 and 126′. The connector element 128 is then moved inwardly to a positioned illustrated in FIG. 11 wherein the connector element 128 is disposed partially within the bottom carton 102 and partially within the top carton 102′ and with the notch 132 partially receiving the bottom carton top wall 104 and the top carton bottom wall 106′ to prevent relative movement therebetween.

Figure 8:
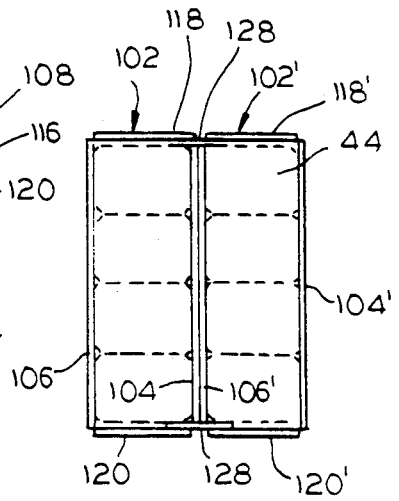
FIG. 8 illustrates an end view of the cartons of FIG. 7 in assembled relation.

Particularly, one connector element 128, for a total of four, is inserted at each corner, to maintain the cartons 102 and 102′ in assembled relation as illustrated in FIG. 8.

Figure 9:
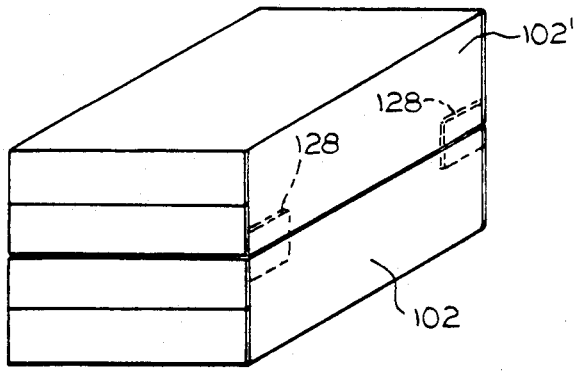
FIG. 9 is a perspective view illustrating the cartons of FIG. 7 fully assembled and sealed.

Once all four connector elements 128 are inserted, then the flaps at one end wall 114 or 116 can be closed and sealed in the normal manner. Thereafter, unless the molds 44 were previously inserted, the molds are end loaded into each carton 102 and 102′. Upon fully loading the cartons, then the opposite end wall can be closed and sealed resulting in the cartons 102 and 102′ being maintained in assembled relation, as illustrated in FIG. 9. Particularly, the connector elements 128 effectively secure the cartons 102 and 102′ against movement relative to one another owing to the interlocking engagement between the connector element notch 132 and the bottom carton top wall 104 and top carton bottom wall 106′, as discussed above.

Figure 11:
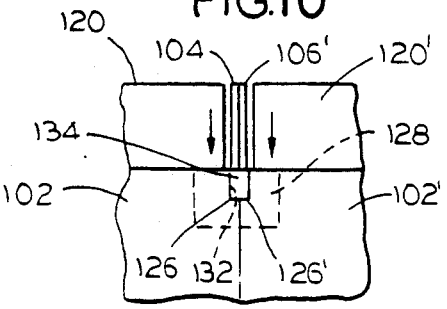

Once in the field, the cartons can be separated by using a cutting instrument to cut through the connector element 128 at the exposed portion 134 illustrated in FIG. 11 along a line extending from the notch 132. Alternatively, the carton end flaps could be opened and the connector elements 128 removed, and then the end flaps can be resealed to provide a pair of separated cartons.

Thus, in accordance with the invention, there is provided an improved packaging assembly which facilities shipment of a pair of cartons to permit economies and to render the cartons more readily usable in the field relative to the goods contained therein.

The illustrated embodiments of the invention are illustrative of the broad inventive concepts comprehended hereby.

We claim:

1. An improved packaging assembly for facilitating shipment and use of goods carried therein, comprising:

a pair of cartons of identical configuration for carrying like goods, each said carton having a rectangular top wall and a rectangular bottom wall connected by four side walls, wherein two of said side walls of each carton comprises open opposite ends having foldable flaps to close and seal said carton; and means for supporting said cartons in assembled relationship with the bottom wall of one said carton being positioned atop the top wall of said other carton is aligned, abutting facial engagement, comprising four connector tabs, wherein two of said tabs are inserted into each open end of both cartons, adjacent opposite side walls, to thereby maintain said cartons in assembled relation incident to folding said flaps to close and seal said cartons during shipment and permitting disassembly during use.

2. The improved packaging assembly of claim 1 wherein each connector is received in a mated slot in each carton.

3. A packaging assembly for facilitating shipment and use of articles contained therein, comprising:

a pair of cartons of identical configuration for carrying like goods, each said carton having a rectangular top wall and a rectangular bottom wall connected by four peripheral walls, including opposite side walls and opposite end walls, one said carton including an elongate slot at each of four corners of the bottom wall along edges intersecting with the side walls and extending from the end walls, the other said carton including an elongate slot at each of four corners of the top wall along edges intersecting with the side walls and extending from the end walls; and means for supporting said cartons in assembled relationship with the bottom wall of said one carton being positioned atop the top wall of said other carton in aligned, abutting facial engagement, comprising four removable U-shaped connector elements each disposed partially within each said carton and registered in select aligned slot in said top and bottom cartons for securing said pair of cartons in assembled relation during shipment and permitting disassembly during use upon removal of said connector elements.

4. The packaging assembly of claim 3 wherein said end walls of each carton comprise open opposite ends having foldable flaps to close and seal said carton to thereby maintain said cartons in assembled relation incident to folding said flaps to close and seal said cartons.

5. The packaging assembly of claim 3 wherein each said connector element comprises a paperboard connector element.

6. The packaging assembly of claim 3 wherein each said connector element comprises a molded plastic connector element.

7. A method of packaging articles comprising the steps of:

providing a first carton for holding a desired quantity of an article to be contained therein, said carton including end opening flaps at opposite ends;

providing a second carton, similar to said first carton, for holding a desired quantity of an article to be contained therein;

stacking said second carton atop said first carton;

inserting a plurality of connector elements into the open end flaps at both opposite ends of said first and said second cartons to maintain the same in aligned, abutting facial engagement;

filling each said carton with a desired quantity of an article to be contained therein;

closing both opposite end flaps of said first carton and said second carton to contain said connector elements to maintain said cartons in assembled relation.

* * * * *

UNITED STATES PATENT AND TRADEMARK OFFICE

CERTIFICATE OF CORRECTION

PATENT NO. : 5,029,710

DATED : July 9, 1991

INVENTOR(S) : Gary Workman, John M. Fitzgerald

It is certified that error appears in the above-identified patent and that said Letters Patent is hereby corrected as shown below:

On the title page, item [75]:

The correct spelling of the second inventor's name is:

JOHN M. FITZGERALD

Signed and Sealed this

Third Day of November, 1992

*Attest:*

DOUGLAS B. COMER

*Attesting Officer*

*Acting Commissioner of Patents and Trademarks*